US007212778B2

(12) United States Patent
Hisakuni

(10) Patent No.: US 7,212,778 B2
(45) Date of Patent: May 1, 2007

(54) CLEANING APPARATUS FOR IMAGE FORMING APPARATUS

(75) Inventor: Hisataka Hisakuni, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 11/090,283

(22) Filed: Mar. 28, 2005

(65) Prior Publication Data

US 2005/0220514 A1 Oct. 6, 2005

(30) Foreign Application Priority Data

Mar. 31, 2004 (JP) ..... 2004-105015

(51) Int. Cl.
*G03G 21/00* (2006.01)
*G03G 15/16* (2006.01)

(52) U.S. Cl. ..... 399/350; 399/101

(58) Field of Classification Search ..... 399/98, 399/99, 101, 343, 350, 351; 15/1.51, 256.5
See application file for complete search history.

(56) References Cited

U.S. PATENT DOCUMENTS 4,264,191 A * 4/1981 Gerbasi et al. ..... 399/350 X
5,438,400 A * 8/1995 Kuribayashi et al. ..... 399/350
5,450,184 A 9/1995 Yanai et al.
5,671,464 A * 9/1997 Kubota ..... 399/101
6,021,304 A * 2/2000 Sbert et al. ..... 399/350 X
6,311,037 B1 10/2001 Hisakuni et al. ..... 399/350
6,377,779 B2 4/2002 Hisakuni ..... 399/350
6,405,015 B1 * 6/2002 Suzuki ..... 399/350
6,473,589 B2 10/2002 Hisakuni ..... 399/350
6,704,539 B2 * 3/2004 Nakayama ..... 399/350
2002/0044808 A1 * 4/2002 Sato et al. ..... 399/350

FOREIGN PATENT DOCUMENTS

JP 56-55979 5/1981
JP 4-212190 8/1992

* cited by examiner

*Primary Examiner*—Sandra L. Brase
(74) *Attorney, Agent, or Firm*—Fitzpatrick, Cella, Harper & Scinto

(57) ABSTRACT

A cleaning apparatus for an image forming apparatus includes a cleaned member and a cleaning member having a cleaning blade coming into contact with a surface of the cleaned member thereby scraping off a toner, wherein the cleaning blade includes an elastic material having an anisotropy in tensile stress and the cleaning blade shows a deformation, resulting from a tensile stress induced in a direction of load by a friction with the cleaned member, smaller than a breaking elongation of the cleaning blade in the vicinity of a contact portion of the cleaning blade with the cleaned member. In this manner a longer service life of the image forming apparatus can be realized while securing a desired cleaning performance.

2 Claims, 2 Drawing Sheets

CLEANING APPARATUS FOR IMAGE FORMING APPARATUS

BACKGROUND OF THE INVENTION

1. Field of the Invention

The present invention relates to a cleaning apparatus for an image forming apparatus utilizing an electrophotographic process such as an electrophotographic copying apparatus or an electrophotographic printer.

2. Related Background Art

Recently, a composite apparatus having functions of all the output terminals for a copying apparatus, a printer, a facsimile and the like is widely accepted in the market. An image forming apparatus utilizing an electrophotographic process is widely accepted as an output terminal adaptable to a network, but a duty cycle of a main body of the apparatus is pointed out as a major issue to be solved.

A duty cycle means a limit print number for which the main body can be operated without a maintenance operation by a service personnel, and one of the largest issues for such duty cycle is a service life of an image bearing member. Also from the ecological point of view, most important issues are an elimination of discarded materials, a reduction in consumables, an extended service life of consumables and an increase in the reliability.

On the other hand, a transition from the prior analog apparatus to a digital configuration is showing a remarkable progress, and a reduction of the cost of a digital apparatus to that of an analog apparatus or lower is also another issue. Furthermore, monochromatic copying apparatus and printer have been principally employed, but full-color originals and output files are showing a rapid increase also in the office market. Thus, there are being desired not only a digital apparatus equivalent to the analog apparatus in cost but also a full-color printer equivalent to the monochromatic apparatus in the cost of the main body and in the running cost, and, for such purposes, a technology capable of drastically reducing TCO (total costs from the standpoint of a user) is desired.

In an image forming apparatus utilizing an electrophotographic process technology, in order to realize a full-color printer having an engine equivalent in cost to a monochromatic printer, there is conceived a technology of employing an intermediate transfer member and superposing images of four colors on the intermediate transfer member by a single photosensitive member. Also an intermediate transfer member constructed as a running belt member increases the freedom of layout in the main body of the printer, thereby enabling a compactization of the apparatus. Therefore, while the photosensitive member alone is an image bearing member in a monochromatic printer, the intermediate transfer member also becomes an image bearing member in a full-color printer, so that a surface cleaning operation is required in a wider area in order to use various image bearing members in repeated image formation cycles.

For cleaning a surface of the image bearing member, there is employed a method of contacting an edge of a cleaning blade, constituted of an elastic material such as rubber, with a surface of an image bearing member to be cleaned and scraping off residual toner adhering to such surface, thereby cleaning such member to be cleaned.

FIG. 2 shows an example of a known cleaning apparatus for cleaning an intermediate transfer member, in which a cleaning blade 19 of a cleaning apparatus is so positioned close as to contact an intermediate transfer belt 4 of a belt shape having an axis perpendicular to the plane of the drawing. Though not illustrated, a photosensitive member and a secondary transfer roller are provided along a periphery of the intermediate transfer belt 4.

Though not illustrated, the cleaning apparatus has a casing having an aperture in a direction toward the intermediate transfer belt 4, and, in the aperture of the casing, there is mounted an edge of the cleaning blade 19 formed for example by urethane rubber. An edge of the cleaning blade 19 is contacted with the intermediate transfer member 4 in a counter direction to a driving direction A thereof, and, a transfer residual toner, generated in an unillustrated secondary transfer portion, upon reaching the edge portion of the cleaning blade 19, is scraped off by the cleaning blade 19.

Also when the transfer residual toner, scraped off and remaining by the cleaning blade 19, is supplied again in a small amount to the edge portion of the cleaning blade 19 by the rotation of the intermediate transfer belt 4, the cleaning blade 19 is prevented from being turned up owing to a lowered friction by the presence of the powder of the transfer residual toner, whereby a satisfactorily stable cleaning performance can be obtained. The cleaning blade 19 is so set, depending on a thickness of a rubber material, a length (free length) of a front rubber portion and a contact pressure, as to achieve an improved toner eliminating ability and a prevention of the turning-up of the cleaning blade.

In order to more satisfactorily clean the transfer residual toner on the image bearing member, it is proposed, for example in Japanese Patent Application Laid-open No. S56-055979 to functionally select constituting materials, such as constituting the cleaning blade with plural layers, and employing a hard material in a portion of the cleaning blade coming into contact with the image bearing member.

In an image forming apparatus utilizing an electrophotographic process technology, because a discharge phenomenon is utilized for example in a charging step, substances such as ozone products adhere to the surface of the image bearing member such as a photosensitive member. Such phenomenon increases a friction between the cleaning blade and the cleaned surface, thereby resulting in a turning-up of the cleaning blade or a perturbation of image formation by a substance adhering to the surface of the image bearing member, thus leading to an image defect. It is therefore desirable that the cleaning blade is easily slidable. Also the cleaning function includes not only an eliminating function for the transfer residual toner remaining on the surface of the image bearing member, but also a function of polishing the cleaned surface. For this reason, a harder surface is preferred for the cleaning blade, but it is difficult to contact a hard material uniformly over a wide area. Therefore, in case of employing a hard cleaning blade for obtaining a long service life, there has been required a pressurizing method for precisely pressing such cleaning blade to the cleaned surface.

Also a technology of realizing a hard surface layer with a low friction by a progress in the rubber material is proposed for example in Japanese Patent Application Laid-open No. H04-212190.

This technology is based on coating a surface of a cleaning blade material with a resin containing lubricant particles. This technology realizes a stable contact state in a simple configuration by the flexibility and the adaptability of the rubber material, also avoids the turning-up of the cleaning blade by the lubricant particles and also provides a polishing function for the surface of the image bearing member by the hard surface layer.

In such configuration, however, because the resinous material is coated thinly on the surface of the cleaning blade, such coated portion may be abraded off or peeled off in a prolonged use, thereby restricting the service life of the cleaning blade.

Also a cleaning blade utilizing an ordinary urethane rubber, though showing a very high frictional coefficient, provides a low frictional coefficient in a three-component system including powder, in the presence of fine particles such as toner.

However the supply of such powder material varies for example by an image to be formed, so that the cleaning blade shows an unstable behavior in an actual contact portion. The polyurethane rubber shows a high abrasion resistance because it is not easily torn when a blade edge is strongly pulled in an eventually unstable friction state, and is not deteriorated by a repetition of such state.

On the other hand, a hard material such as a resinous material is, in comparison with a soft material such as a rubber material, stronger in a resistance against an external force such as an elongation or compression, but is smaller in a possible amount of elongation or contraction. Therefore, in case a cleaning blade is made harder only in a vicinity of a portion coming into contact with the image bearing member, a portion close to the surface of the cleaning blade cannot withstand a deformation by an elasticity of the entire cleaning blade, whereby the cleaning blade is abraded or broken to result in for example a chipping in the blade, thereby deteriorating the cleaning ability.

Also polyurethane rubber, commonly employed in the cleaning blade, is resistant to repeated deformation as long as physical properties are not changed, but the resinous material generally shows a deterioration such as a decrease in a tensile stress or a decrease in a breaking elongation, by repeated deformations.

While a longer service life for the image bearing member is being realized for example by an improvement in the abrasion resistance of the photosensitive member, the cleaning blade are now required to meet various functions and a longer service life is also essential for the cleaning blade itself.

SUMMARY OF THE INVENTION

The present invention has been made in consideration of the foregoing.

An object of the present invention is to provide a cleaning apparatus for use in an image forming apparatus, capable of attaining a longer service life of the image forming apparatus while securing a desired cleaning performance.

An object of the present invention is to provide a cleaning apparatus utilizing a cleaning blade constituted of an elastic member having an anisotropy in a tensile stress.

Another object of the present invention is to achieve a longer service life of a cleaning apparatus, by employing a cleaning blade which has an anisotropy in elastic characteristics while maintaining a durability of the cleaning blade.

Still another object of the present invention is to provide a cleaning apparatus for an image forming apparatus, the cleaning apparatus including an image bearing member and a cleaning member having a cleaning blade coming into contact with a surface of the image bearing member thereby scraping off a toner, wherein the cleaning blade includes an elastic material having an anisotropic tensile stress and the cleaning blade shows a deformation, resulting from a tensile stress induced in a direction of load by a friction with the image bearing member, smaller than a breaking elongation in the vicinity of a contact portion of the cleaning blade with the image bearing member.

DETAILED DESCRIPTION OF THE PREFERRED EMBODIMENTS

Figure 1:
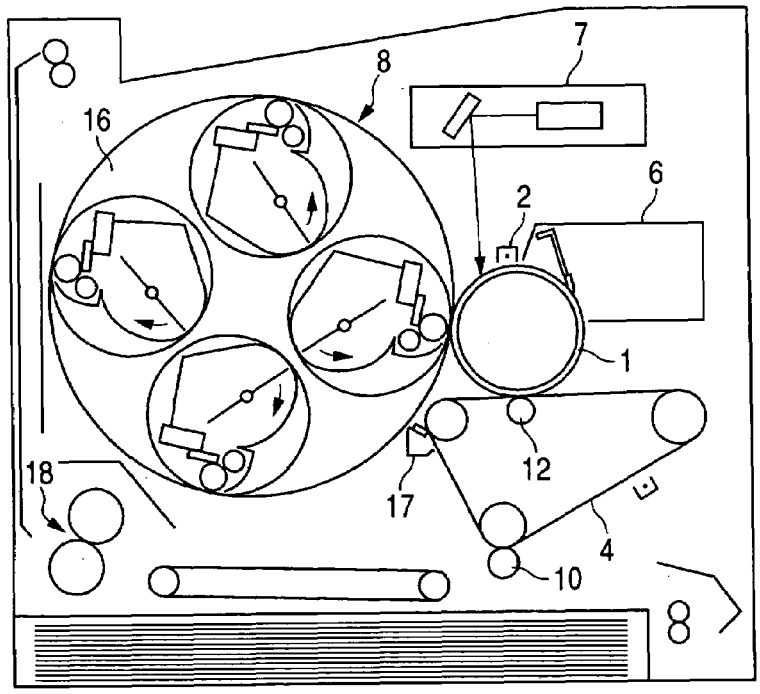
FIG. 1 is a schematic cross-sectional view of an image forming apparatus equipped with a cleaning apparatus of the present invention.
Figure 2:
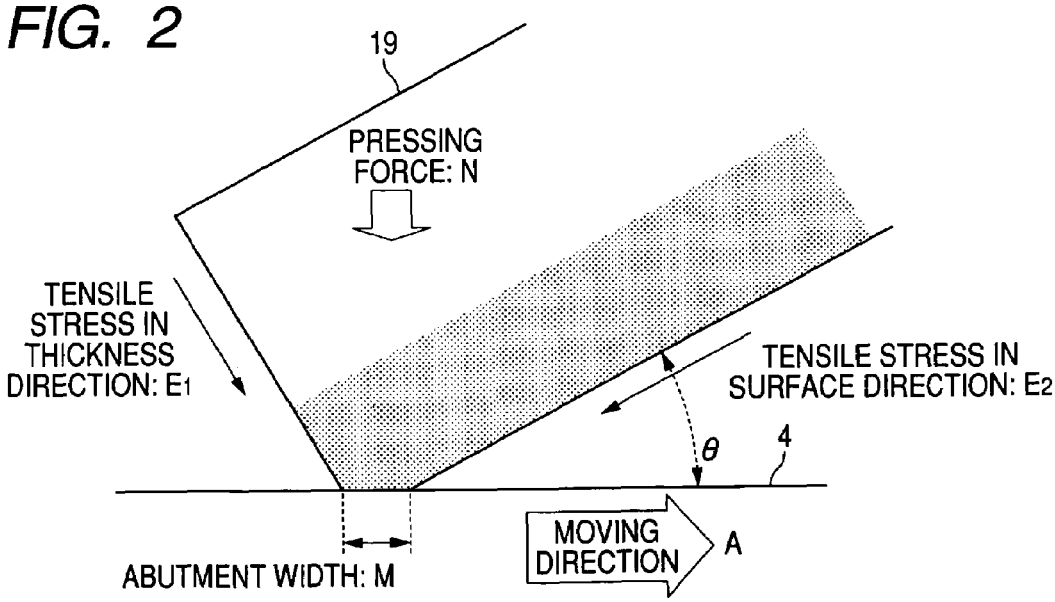
FIG. 2 is a lateral cross-sectional view showing a contact state of a cleaning blade with an image bearing member.

In the following, embodiments of the present invention will be explained with reference to the accompanying drawings. FIG. 1 is a schematic cross-sectional view of an image forming apparatus equipped with a cleaning apparatus of the present invention, and FIG. 2 is a lateral cross-sectional view showing a contact state of a cleaning blade with an image bearing member.

(Image Forming Apparatus)

An image forming apparatus shown in FIG. 1 is a copying apparatus of an electrophotographic process, for forming an image on a recording medium according to an image signal supplied for example from an computer (not shown).

In the image forming apparatus, a photosensitive member 1 is uniformly charged by charging means 2, and is then irradiated with a light by a laser oscillator 7 according to the image signal. In response, an electrostatic latent image is formed in a portion on the photosensitive member 1 subjected to such light irradiation, and is then developed into a visible image in a development apparatus 8, utilizing a toner serving as a developer.

An intermediate transfer member 4 is pressed to the photosensitive member by a primary transfer roller 12, which is given a transfer voltage to transfer the visible toner image, from the photosensitive member 1 onto the intermediate transfer member 4.

For forming a full-color image, a development rotary member 16 rotates in the development apparatus 8 to switch a color of development, and a visible toner image of a second color, formed similarly on the photosensitive member 1, is transferred in superposition onto the intermediate transfer belt 4.

Thereafter, after the toner images of four colors are transferred in superposition onto the intermediate transfer member 4, a sheet as a recording medium is supplied from a cassette to a position of a secondary transfer roller 10, and the toner images of four colors are collectively transferred onto the sheet and the toner images on the sheet are subjected to heat and pressure in fixing means 18, thereby being fixed to the sheet. Thereafter, the toners remaining on the photosensitive member 1 and the intermediate transfer member 4, both constituting members to be cleaned, are respectively cleaned by a photosensitive member cleaning apparatus 6 and a cleaning apparatus 17 for use again in an image formation.

The present embodiment employs, as the photosensitive member 1, an OPC (organic photoconductor) photosensitive member formed by coating a charge generation layer utilizing a titanyl phthalocyanine pigment and a charge transport layer utilizing a bisphenol-Z polycarbonate as a binder, but there may also be employed an a-Si photosensitive member or a Se photosensitive member.

Also a toner employed in the present embodiment contained a core of an ester wax, a resin layer of styrene-butyl acrylate and a surface layer of a styrene polyester. A developer was formed by a mixture, as a 2-component developer, of a polymerization toner so prepared to have a shape factor SF-1 within a range of $100 \leqq SF\text{-}1 \leqq 140$ and a shape factor SF-2 within a range of $100 \leqq SF\text{-}2 \leqq 120$, and of a resinous magnetic carrier prepared by a polymerization method.

The present embodiment employed, as the intermediate transfer member 4, a belt-shape member of a polyimide resin sheet (volumic resistivity of about $10^9$–$10^{10}$ Ωcm) of a thickness of 100 μm.

(Cleaning Apparatus)

The intermediate transfer member cleaning apparatus 17 is provided with an unillustrated casing having an aperture at the side of the intermediate transfer member 4, and a cleaning blade 19 shown in FIG. 2 is mounted by a support member in the aperture of the casing. The cleaning blade 19 is in abutment, at an edge thereof, with the intermediate transfer member 4, and a residual toner, that has not been transferred to the sheet at the secondary transfer roller 10, upon reaching such edge, is scraped off by such edge. In a lower part of the casing, a scooping sheet is provided and the scraped toner drops into the casing and is prevented, by such scooping sheet, from returning in a large amount to the intermediate transfer member 4.

The casing is provided therein with carrying means for discharging the residual toner, and the residual toner dropping into the casing is carried in a direction perpendicular to the plane of the drawing and is discharged from the cleaning apparatus 17. Such configuration prevents a clogging of the casing by the residual toner.

In the cleaning apparatus 17 which abuts the cleaning blade 19 in a counter direction to the photosensitive member 1 or the intermediate transfer member 4 constituting the cleaned members, an effective tensile stress E' induced in a direction of load by a friction of the cleaning blade with the cleaned member defined by:

$$1/E' = \sin^2\theta/E1 + \cos^2\theta/E2 \quad (1)$$

satisfies a condition:

$$(\mu N/M)/E' < L/100 \quad (2)$$

wherein a abutment pressure of the cleaning blade per unit longitudinal length is represented by (N/m); θ (°) is an abutment angle between a tangential line to the cleaned member and the cleaning blade; E1 ($N/m^2$) is a tensile stress when a plate-shaped elastic member is elongated by 5% in a direction of thickness; E2 ($N/m^2$) is a tensile stress when a plate-shaped elastic member is elongated by 5% in a direction along surface; μ is a friction coefficient between the cleaning blade and the cleaned member under these conditions; M (m) is a contact width of the cleaning blade and the cleaned member; and L (%) is a breaking elongation of the cleaning blade in a portion close to the abutment portion.

It is also preferred that an elongation L' (%) at which a material of the cleaning blade in the vicinity of the abutment portion shows a breaking by repeated elongations less than 1000 times satisfies a following condition:

$$(\mu N/M)/E' < L'/100 \quad (3).$$

In the following, there will be explained an apparent tensile stress E' of an edge in a cleaning blade, having an anisotropy in the tensile elasticity.

Figure 3:
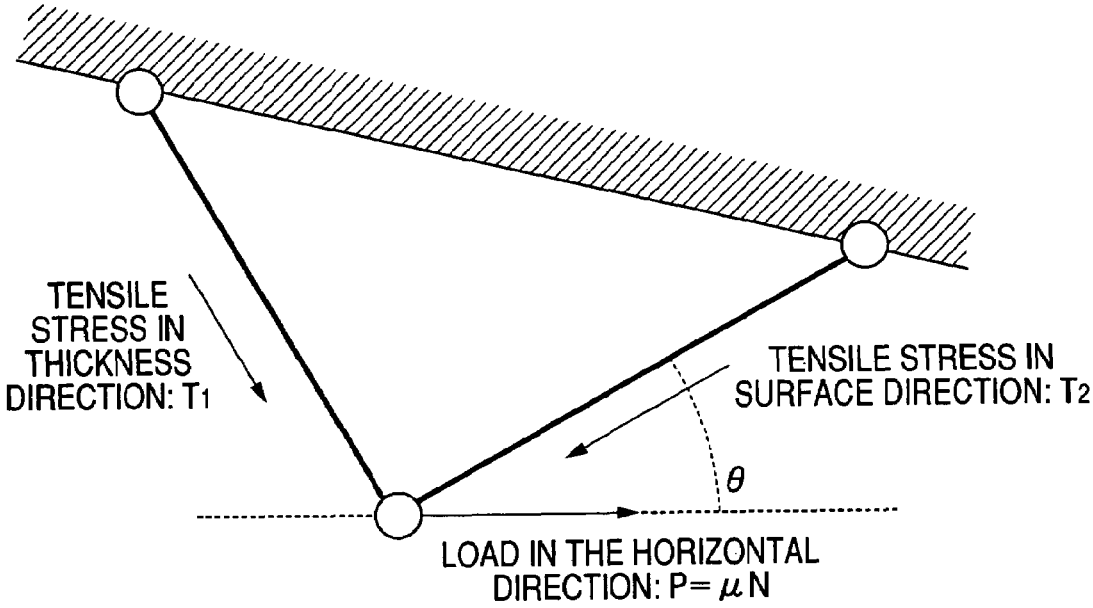
FIG. 3 is a schematic lateral cross-sectional view showing a tensile force applied to the cleaning blade.

As a deformation in the vicinity of the abutment portion of the cleaning blade is a micro deformation, and as the vicinity of the surface constitutes a free end, an approximation was made with a truss shaped as shown in FIG. 3. In FIG. 3, A, B and C constitute fulcrums and the entire cleaning blade is approximated by an elastic member A-B and an elastic member A-C, in which points B and C are fixed. For the purpose of simplicity, it is approximated that, in the interior of the cleaning blade constituted by a plate-shaped elastic member, a pressure N per unit longitudinal length is balanced with a reaction force from the cleaned surface so that no vertical force is applied to the truss. More specifically, as the deformation area is a micro area, it is assumed that the deformation area is same in the thickness direction and in the surface direction, and that two rod-shaped members, having cross sections defined by an actual abutment width M and a longitudinal width O (not shown) both in the thickness direction and the surface direction, are fixed at a point and a frictional force P=μN is applied to the fixed point in a horizontal direction in the illustration.

For a tensile force T1 per unit longitudinal length of the member corresponding to the thickness direction and a tensile force T2 per unit longitudinal length of the member corresponding to the surface direction, following equations stand by the balance of the forces in the horizontal direction and in the vertical direction:

$$T1 \cdot \sin\theta - T2 \cdot \cos\theta = \mu N$$

$$T1 \cdot \cos\theta + T2 \cdot \sin\theta = 0$$

Therefore:

$T1 = \mu N \cdot \sin\theta$ $T2 = -\mu N \cdot \cos\theta$

Although T2 is in a compressing direction, but is considered same as a tensile stress because there is involved a micro deformation.

An elongation can be calculated from {(stress per unit area×length)/tensile stress}, but assuming that the truss has a length same in the thickness direction and in the surface direction because of a micro deformation, a strain amount L0 can be approximated as:

$$L0 = (\mu N/M) \times (\sin^2\theta/E1 + \cos^2\theta/E2).$$

Therefore an apparent tensile stress E' is given by:

$$1/E' = \sin^2\theta/E1 + \cos^2\theta/E2.$$

Therefore, the cleaning blade does not break by employing an elastic member of which breaking elongation does not exceed L0 in the vicinity of the edge of the cleaning blade.

Also an elastic member is known to have properties as an elasto-plastic member and to be deteriorated by a fatigue. Particularly in an elastic member close to a resin of a high tensile stress, the breaking elongation is lowered by repeating an elongation of a certain amount. As a physical amount for defining a repeated fatigue, there is adopted a maximum elongation which causes a breaking of the elastic material by repeated elongations by 1000 times or less at a desired elongation amount.

EXAMPLE 1

A cleaning blade 19 employed in the present example had a structure as shown in FIG. 2. The material of the cleaning blade 19 includes an elastic material having anisotropy in the tensile stress. More specifically, the cleaning blade 19 is formed into a plate shape of a thickness of 2 mm by laminating polyurethane rubbers of 2 kinds, formed by two materials and having different physical values in the direction of thickness.

In the rubber material in the abutment portion of the cleaning blade, a tensile stress under a 5% elongation, measured in the thickness direction and in the surface direction in the vicinity of the edge portion on a sample remade into a shape similar to the shape defined in a tensile test method for vulcanized rubber (JIS-K-6251), was $0.1\times10^6$ N/m$^2$ in the thickness direction and $1.0\times10^7$ N/m$^2$ in the surface direction. Also the rubber material in the vicinity of the abutment portion showed a breaking elongation of 18%.

Also a breaking elongation in repeated elongations was measured by preparing a sample of a shape same as in the breaking elongation measurement in JIS (sample JIS No. 1), and a desired elongation was given repeatedly by a tensile test machine. A tensile force was applied repeatedly with a tensile speed of 20 m/sec.

The cleaning blade, when given an elongation same as the breaking elongation defined by JIS, breaks by a single elongation, while it does not break in a single elongation under a smaller elongation but breaks sooner or later when such elongation is given repeatedly. A minimum elongation causing a breakage within 1000 times is defined as a breaking elongation L' by repeated elongations. In the cleaning blade employed in the present example, the rubber material in the vicinity of the abutment portion showed a breaking elongation L' of 10% under repeated elongations.

The cleaning blade formed by such plated-shaped urethane rubber was contacted in a counter direction with the intermediate transfer member, so as to obtain a contact angle of 30°. The abutment pressure was selected as 3 N/m$^2$. A lower abutment pressure of the cleaning blade reduces the tensile force, but a minimum necessary abutment pressure is determined by the cleaning performance.

A friction coefficient between the cleaning blade and the intermediate transfer member, measured by Tribogear TYPE 14DR, manufactured by Shinto Kagaku Co., was 0.4 in a state where toner was present therebetween.

Also an actual abutment width between the cleaning blade and the intermediate transfer member in a stationary state was 5 μm in a measurement in a similar abutment state on a glass plate, by an optical microscope from a rear surface.

Thus an apparent tensile stress in a direction in which the cleaning blade is pulled by a friction with the intermediate transfer member is calculated from the equation (1) as $3.1\times10^6$ N/m$^2$, so that an apparent strain L0 becomes 7.7% from the equation (2), thus satisfying the relation (3).

There was utilized a copying apparatus NP4050 (trade name) manufactured by Canon Inc., so modified as to realize the aforementioned configuration. An evaluation by the cleaning performance after a 100,000-sheet passing durability test showed a satisfactory cleaning ability.

COMPARATIVE EXAMPLE 1

The cleaning blade employed in Example 1 was replaced by a cleaning blade constituted of a plate-shaped elastic member formed by laminating polyurethane so as to obtain a tensile stress of $1.0\times10^7$ N/m$^2$ in the thickness direction, a tensile stress of $1.0\times10^6$ N/m$^2$ in the surface direction, and a breaking elongation of 6%. The cleaning blade was prepared as a plate of a thickness of 2 mm, and was contacted with similar abutment conditions.

This cleaning blade showed a friction coefficient of 0.4 at use, a necessary abutment pressure of 3N, and an abutment width of 5 μm in a stationary state.

Thus an apparent tensile stress in a direction in which the cleaning blade is pulled by a friction with the intermediate transfer member is calculated from the equation (1) as $1.3\times10^6$ N/m$^2$, so that an apparent strain L0 becomes 18% from the equation (2), thus not satisfying the relation (3).

The cleaning blade of the present Comparative Example, when employed in a copying apparatus, showed a chipping in the abutment portion of the cleaning blade after passing several tens of sheets, whereby the cleaning operation became impossible. This was because, as the condition (3) was not satisfied, the cleaning blade showed a local deformation in the vicinity of the abutting edge, and could not withstand the breaking.

COMPARATIVE EXAMPLE 2

The cleaning blade employed in Example 1 was replaced by a plate-shaped elastic member formed by laminating fluorinated rubber. It showed a tensile stress of $0.5\times10^6$ N/m$^2$ in the thickness direction, a tensile stress of $1.0\times10^7$ N/m$^2$ in the surface direction, and a breaking elongation of 30%.

A laminated elastic member magnifying the vicinity of the abutting portion of the cleaning blade in a similar form was prepared and subjected to a measurement of a breaking elongation in repeated elongations, which resulted in 5%. This cleaning blade was contacted in a counter direction with a same abutment angle as in Example 1. This cleaning blade showed a friction coefficient of 0.1 in use. A necessary abutment pressure was selected as 5N/m, for achieving a sufficient cleaning with the fluorinated rubber of a larger surface roughness. In such state, an abutment width was 5.5 μm in a stationary state.

Thus an apparent tensile stress in a direction in which the cleaning blade is pulled by a friction with the intermediate transfer member is calculated from the equation (1) as $1.7\times10^6$ N/m$^2$, so that an apparent strain L0 becomes 5.3% from the equation (2), thus not satisfying the relation (3).

The cleaning blade of the present Comparative Example, when employed in a copying apparatus, provided a satisfactory result up to 10,000 prints, but thereafter showed a chipping in the abutment portion of the cleaning blade, whereby the cleaning operation became impossible. This was because a satisfactory cleaning performance was obtained for a short term because the relation (2) for the breaking elongation is satisfied, but the durability is deficient as the condition (3) for the breaking elongation under repeated elongations was not satisfied.

EXAMPLE 2

Figure 4:
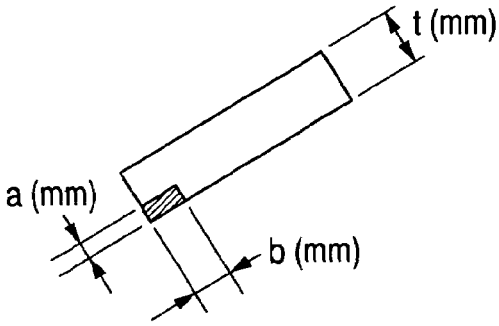
FIG. 4 is a schematic lateral cross-sectional view of a cleaning blade showing an embodiment 2 of the present invention.

A cleaning blade employed in this example had a structure shown in FIG. 3. This cleaning blade employed a rubber material same as in Example 1 in the vicinity of the abutting portion of the cleaning blade, and, as shown in FIG. 4, a dimension a of 0.5 mm in the thickness direction in the vicinity of the abutting portion, a dimension b of 1.0 mm along the abutting surface, and a thickness t of 2 mm of the cleaning blade.

As the influence of the force which the cleaning blade receives from the cleaned surface is limited to the vicinity of the abutting nip, it is effective to restrict the cleaning function to the vicinity of such abutting nip.

In the present example, the cleaning blade showed a tensile stress of $1.0\times10^6$ N m$^2$ in the thickness direction, and $5.0\times10^6$ N m$^2$ in the surface direction. Also the rubber material in the vicinity of the abutment portion showed a breaking elongation of 18%. Also in the cleaning blade employed in this example, a rubber material in the vicinity of the abutting portion shows a breaking elongation L' under repeated elongations of 12%.

This cleaning blade showed a friction coefficient of 0.4 in use, a necessary abutment pressure of 3N and an abutment width of 5 μm in a stationary state.

Though the tensile stress of the cleaning blade in the surface direction was lowered in comparison with Example 1, an apparent elastic modulus E' became $2.5\times10^6$ N/m$^2$ and an apparent strain L0 became 9.8 from the equation (2), thus satisfying the relation (3).

There was utilized a copying apparatus NP4050 (trade name) manufactured by Canon Inc., so modified as to realize the aforementioned configuration. An evaluation by the cleaning performance after a 100,000-sheet passing durability test showed a satisfactory cleaning ability.

This application claims priority from Japanese Patent Application No. 2004-105015 filed Mar. 31, 2004, which is hereby incorporated by reference herein.

What is claimed is:

1. A cleaning apparatus for an image forming apparatus, comprising:

a cleaned member; and a cleaning blade coming into contact with a surface of the cleaned member thereby scraping off a toner, said cleaning blade including an elastic material having an anisotropy in tensile stress;

wherein a breaking elongation L (%) of the cleaning blade in a portion close to the abutment portion satisfies:

$$L/100>(\mu N/M)\times(\sin^2\theta/E1+\cos^2\theta/E2)$$

wherein N (N/in) is an abutment pressure of said cleaning blade per unit longitudinal length at an abutment part in which said cleaning blade abuts against said cleaned member; θ (degrees) is an abutment angle between a tangential line of the cleaned member and the cleaning blade at the abutment part in a downstream direction to which said cleaned member moves; E1 (N/m$^2$) is a tensile stress at 5% elongation in a direction of thickness of the elastic material; E2 (N/m$^2$) is a tensile stress at 5% elongation in a direction of a plane substantially perpendicular to the direction of the thickness of the elastic material; M (m) is a contact length between said cleaning blade and said cleaned member in a direction to which said cleaning blade moves and μ is a friction coefficient between the cleaning blade and the cleaned member under a condition wherein said cleaning blade abuts against said cleaning blade by the abutment pressure per unit longitudinal length N(N/m) with the abutment angle θ (degrees).

2. A cleaning apparatus according to claim 1, wherein an elongation L' (%) at which a material of the cleaning blade in the vicinity of the abutment portion shows a breaking condition by repeated elongations less than 1000 times satisfies:

$$L'/100>(\mu N/M)\times(\sin^2\theta/E1+\cos^2\theta/E2).$$

* * * * *

UNITED STATES PATENT AND TRADEMARK OFFICE

CERTIFICATE OF CORRECTION

PATENT NO. : 7,212,778 B2
APPLICATION NO. : 11/090283
DATED : May 1, 2007
INVENTOR(S) : Hisataka Hisakuni It is certified that error appears in the above-identified patent and that said Letters Patent is hereby corrected as shown below:

COLUMN 2:
Line 43, "is" should read --be--.

COLUMN 3:
Line 37, "are" should read --is--.

COLUMN 4:
Line 27, "an" should read --a--.

COLUMN 5:
Line 44, "a" should read --an--.
Line 60, "satisfies" should read --satisfy--.

COLUMN 8:
Line 61, "$Nm^2$" should read --$N/m^2$--.

COLUMN 10:
Line 1, "(N/in)" should read --(N/m)--.
Line 17, "said cleaning blade" should read --said cleaned member--.

Signed and Sealed this

Twenty-fifth Day of December, 2007

JON W. DUDAS
*Director of the United States Patent and Trademark Office*